United States Patent [19]

Jungesjo

[11] Patent Number: 4,470,290

[45] Date of Patent: Sep. 11, 1984

[54] THIN-WALL SLEEVE FORMING

[75] Inventor: Harald N. Jungesjo, Rochester, Mich.

[73] Assignee: Anderson-Cook, Inc., Fraser, Mich.

[21] Appl. No.: 299,444

[22] Filed: Sep. 4, 1981

[51] Int. Cl.[3] ..... B21J 7/16

[52] U.S. Cl. ..... 72/402; 72/370; 72/452; 29/159.2

[58] Field of Search ..... 72/402, 400, 370, 452, 72/383; 29/159.2

[56] References Cited

U.S. PATENT DOCUMENTS

| | | | |
|---|---|---|---|
| 874,448 | 12/1907 | Smith | 29/159.2 |
| 1,375,334 | 4/1921 | Strong et al. | 72/402 |
| 2,654,942 | 10/1953 | May . | |
| 2,724,975 | 11/1955 | Drummond . | |
| 2,729,110 | 1/1956 | Killian et al. . | |
| 2,923,166 | 2/1960 | Brindley et al. . | |
| 3,286,329 | 11/1966 | Naruse et al. . | |
| 3,347,082 | 10/1967 | Clerk . | |
| 3,396,570 | 8/1968 | McCardell . | |
| 3,982,415 | 9/1976 | Killop . | |
| 4,028,922 | 6/1977 | Killop . | |
| 4,131,032 | 12/1978 | Warland et al. . | |
| 4,155,237 | 5/1979 | Jungesjo . | |

OTHER PUBLICATIONS

Chilton's Automotive Industries, Jun. 1978, pp. 234 and 235.

*Primary Examiner*—Daniel C. Crane
*Assistant Examiner*—David B. Jones
*Attorney, Agent, or Firm*—Reising, Ethington, Barnard, Perry & Milton

[57] ABSTRACT

Apparatus (22,22') for forming thin-wall sleeves (24) is disclosed as including a spring biaser (52) for tools (48) of the apparatus. A mandrel (36) and a tool housing (42) cooperate to mount the sleeve (24) for forming under the impetus of an actuator (54) that moves the tools (48) against the force of the spring biaser (52). Upon such tool movement, forming ends (50) of the tools form the sleeve (24) into circumferentially spaced recesses (40) of the mandrel to provide sleeve splines or teeth (56). The spring biaser (52) preferably includes a plurality of springs (92) mounted within associated spring openings (98) in the tool housing between tool slots (46) in which the tools (48) are supported for movement. In one embodiment, the forming is performed inwardly with the sleeve mounted about an internal mandrel. In another embodiment, the forming is performed outwardly with the sleeve mounted within an external mandrel.

10 Claims, 12 Drawing Figures

THIN-WALL SLEEVE FORMING

TECHNICAL FIELD

This invention relates to apparatus for forming a metallic thin-wall sleeve of a unitary annular construction.

BACKGROUND ART

The prior art discloses thin-wall sleeve forming to provide teeth or splines used to transmit torque. Such prior thin-wall sleeve forming and apparatus for performing the forming are disclosed by the references discussed below.

U.S. Pat. No. 3,286,329 discloses a process for manufacturing a gear by explosively deforming a metallic outer shell to include teeth and thereafter filling the interior of the toothed shell with a filler material preferably taught to be aluminum, a synthetic resin, or a liquid. To perform the forming, the metallic shell blank is mounted on a recessed die and immersed within a liquid in which the explosion takes place to deform the blank to the recessed shape of the die and thereby form the shell teeth. Thereafter, the interior of the toothed shell is filled to provide support to the teeth.

U.S. Pat. No. 3,982,415 discloses a power transmission member having a thin-wall sleeve that is formed by a rolling process to include splines. The spline forming is performed by initially mounting the sleeve on a toothed mandrel between a pair of dies embodied by elongated racks. Movement of the die racks meshes the rack and mandrel teeth with the sleeve therebetween to form the splines.

U.S. Pat. No. 4,028,922 discloses thin-wall sleeve forming apparatus including a pair of dies, each of which has at least two tooth groups for cooperating with a toothed mandrel to perform splining by meshing of the die and mandrel teeth with the thin-wall sleeve between the meshing teeth. A leading tooth group of each die has teeth spaced farther from each other than the teeth of a following tooth group such that a first set of splines is initially formed and a second set of splines is thereafter formed between the first set. Also, either reverse movement of the dies in one embodiment or an additional trailing tooth group of farther spaced teeth is utilized to mesh farther spaced teeth with the formed splines while skipping at least alternating locations between the splines to correct any out of roundness of the splined sleeve.

U.S. Pat. No. 4,155,237 discloses a thin-wall sleeve splining machine including an automatic loader used in cooperation with a mandrel and a pair of toothed dies that form splines or teeth in a thin-wall sleeve by meshing of die and mandrel teeth with the sleeve between the meshing teeth.

Also, prior gears or sprockets for vehicle timing chains have been made with a thin-walled toothed outer sleeve of metal that is mounted on an annular wall which supports the sprocket on a central hub. The teeth are formed in the sleeve by radial tool segments displaced by movement of the press ram into associated die recesses.

Additional references which disclose thin-wall sleeve forming or other forming include U.S. Pat. Nos.: 874,448; 2,654,942; 2,724,975; 2,729,110; 2,923,166; 3,347,082; 3,396,570; and 4,131,032.

DISCLOSURE OF INVENTION

An object of the present invention is to provide improved apparatus for forming a metallic thin-wall sleeve of a unitary annular construction having a central axis.

In carrying out the above object, the apparatus includes a mandrel that mounts the sleeve and has recesses spaced circumferentially about the central axis of the mounted sleeve. A tool housing of the apparatus cooperates with the mandrel in mounting the sleeve and has tool slots that are spaced circumferentially about the central axis of the mounted sleeve extending radially with respect to this axis in alignment with the mandrel recesses. A plurality of tools are respectively mounted by the tool slots and have forming ends that form the sleeve. The apparatus includes a spring biaser that biases the tools radially away from the sleeve. An actuator of the apparatus moves the tools radially against the force of the spring biaser such that the forming ends of the tools form the sleeve into the recesses of the mandrel whereupon the actuator allows the spring biaser to move the tools radially away from the formed sleeve.

In the preferred construction of the apparatus, the spring biaser includes a plurality of springs each of which is mounted between a pair of adjacent tools to provide biasing thereof away from the mounted sleeve. Each tool includes a pin extending generally circumferentially therefrom in opposite directions, and each pin has opposite ends engaged by the springs on each side of the associated tool. The tool housing includes spring openings respectively located between the tool slots with the springs respectively received within the spring openings, and the pin ends project into the spring openings to engage the springs in order to bias the tools. The tool housing includes an annular groove that defines the spring openings between each pair of adjacent tool slots. A tool housing support cooperates with the tool housing to maintain the springs within the spring openings defined by the annular groove between the tool slots.

In the preferred construction of the apparatus, each tool also includes an actuating end disclosed as having an angled construction with respect to the axis of the mounted sleeve. The actuator includes an actuating member having a cone surface that engages the actuating ends of all of the tools. A cylinder of the actuator is disclosed as being of the hydraulic type and moves the actuating member axially with respect to its cone surface to move the tools radially. Initial cylinder operation during each cycle moves the cone member axially in one direction to move the the tools against the force of the spring biaser to form the sleeve, and subsequent cylinder operation moves the cone member axially in the opposite direction to permit the spring biaser to move the tools away from the formed sleeve.

In one disclosed embodiment, the sleeve forming is performed in an inward direction. This embodiment includes a tool housing having an opening in which the mandrel is located. The mandrel of this embodiment has a central axis concentric with the central axis of the mounted sleeve and includes outwardly extending teeth that engage the mounted sleeve and define recesses between the adjacent pairs of teeth. The tool housing has tool slots spaced circumferentially about the central axis of the mandrel extending radially with respect thereto in alignment with the recesses of the mandrel. Each of the tools has an elongated shape including an intermediate portion extending between the ends thereof and including the pin that projects in opposite directions into the spring openings defined on each side of the associated tool slot by the annular groove of the tool housing. Each of the springs is of the helical type with one end engaged with the tool housing and another end engaged with both pin ends projecting into the associated spring opening such that the springs bias the tools radially outward away from the sleeve. Operation of the actuator by movement of its actuating member under the impetus of the hydraulic cylinder moves the tools to perform the sleeve forming.

In another embodiment of the apparatus, the forming is performed in an outward direction. In this embodiment, the mandrel includes an opening in which the tool housing is located and the spring biaser biases the tools radially inward while the actuator moves the tools radially outward to form the sleeve.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
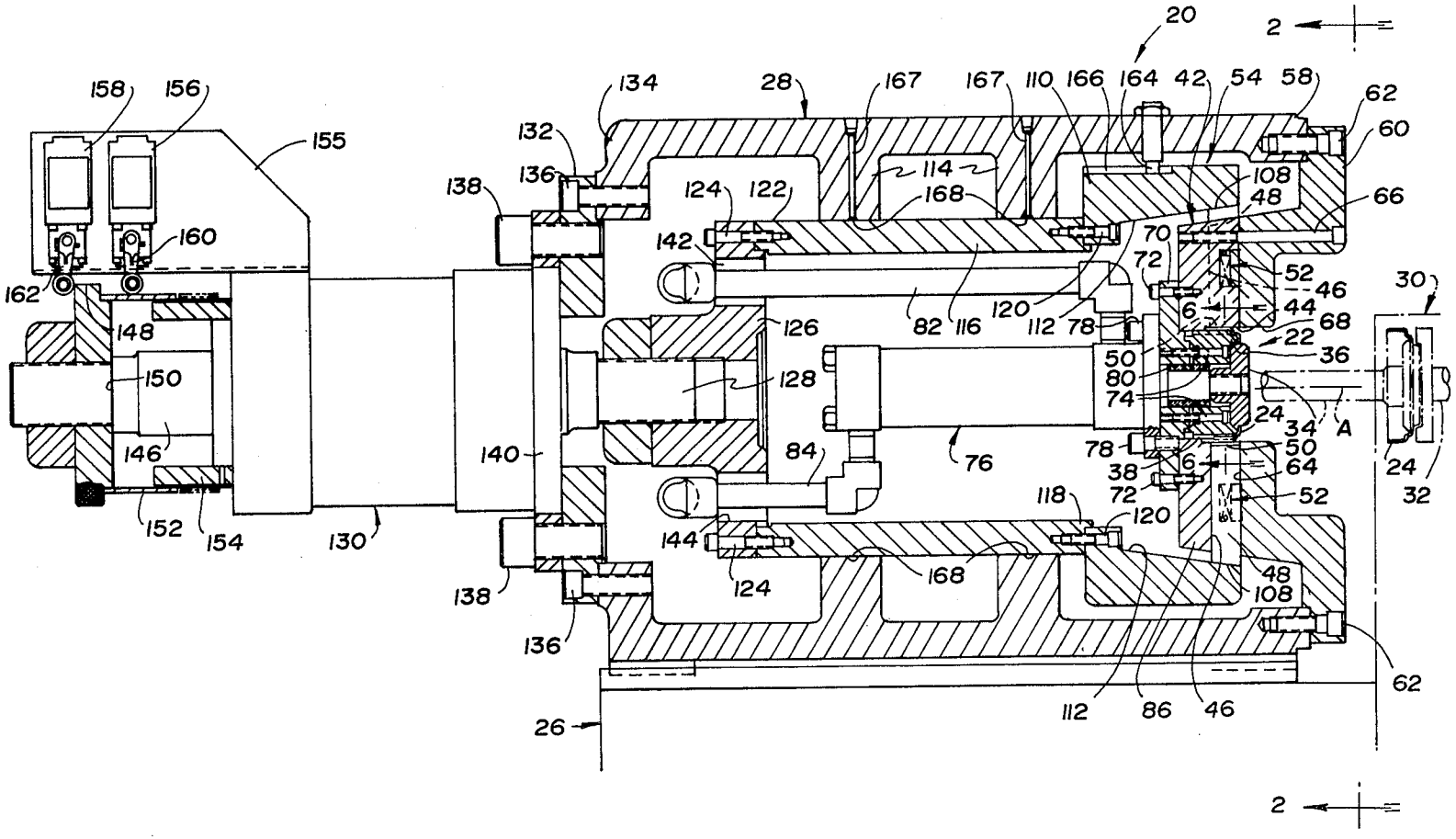
FIG. 1 is a side elevation view taken in section through a machine including apparatus for forming a metallic thin-wall sleeve in accordance with the present invention.

Referring to FIG. 1 of the drawings, a machine generally indicated by 20 includes apparatus 22 constructed in accordance with the present invention for forming a metallic thin-wall sleeve 24 of a unitary annular construction having a central axis A about which the forming takes place as is hereinafter more fully described. Machine 20 includes a suitable base 26 and a cast metal housing 28 that is mounted on the base and supports the forming apparatus 22. A loader 30 such as of the type disclosed by U.S. Pat. No. 4,155,237 includes a loading member 32 and an unloading member 34 that cooperate to load the sleeve banks to be formed and to unload the formed sleeves.

Figure 2:
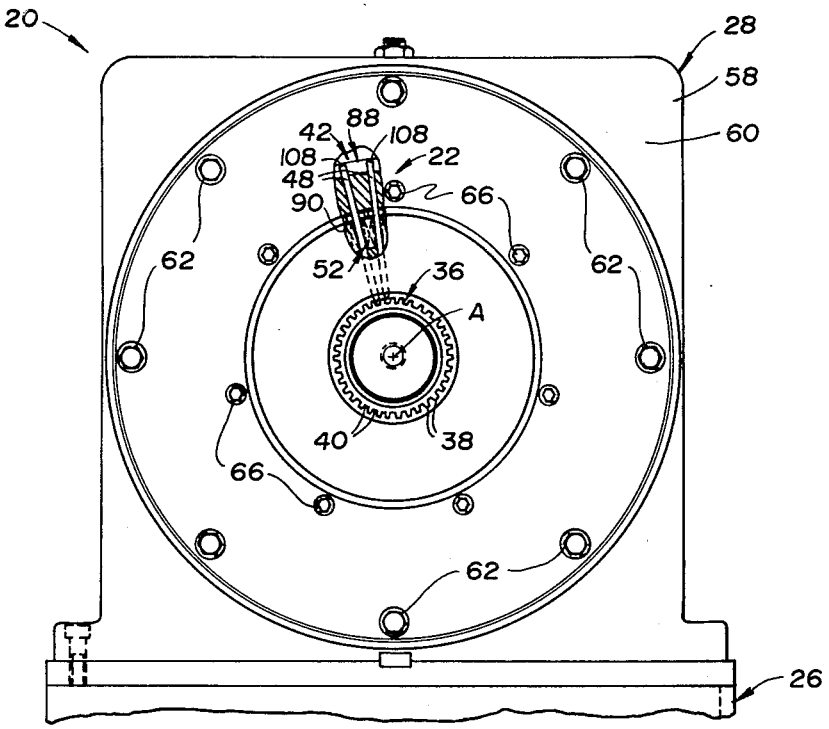
FIG. 2 is a front elevation view taken along the direction of line 2—2 in FIG. 1 and partially broken away to illustrate the construction of a spring biaser for tools of the apparatus.
Figure 5:
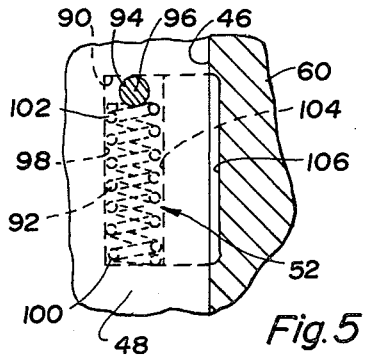
Figure 6:
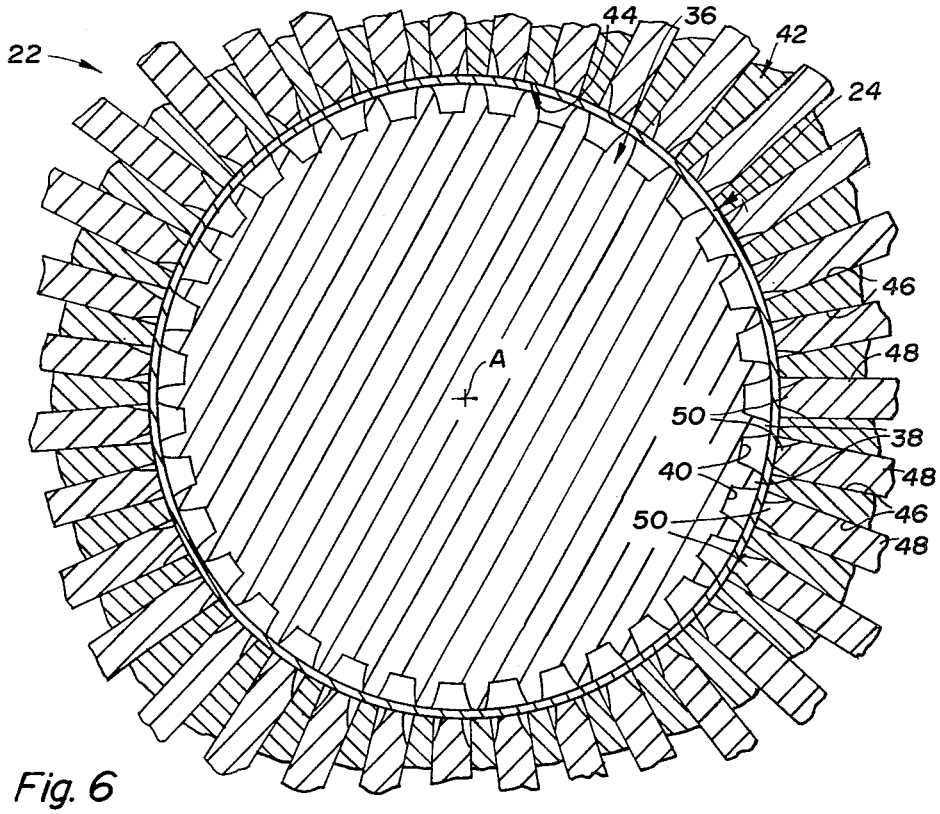
FIG. 6 is a sectional view taken through the apparatus along the direction of line 6—6 in FIG. 1 prior to forming of the sleeve by the tools.
Figure 7:
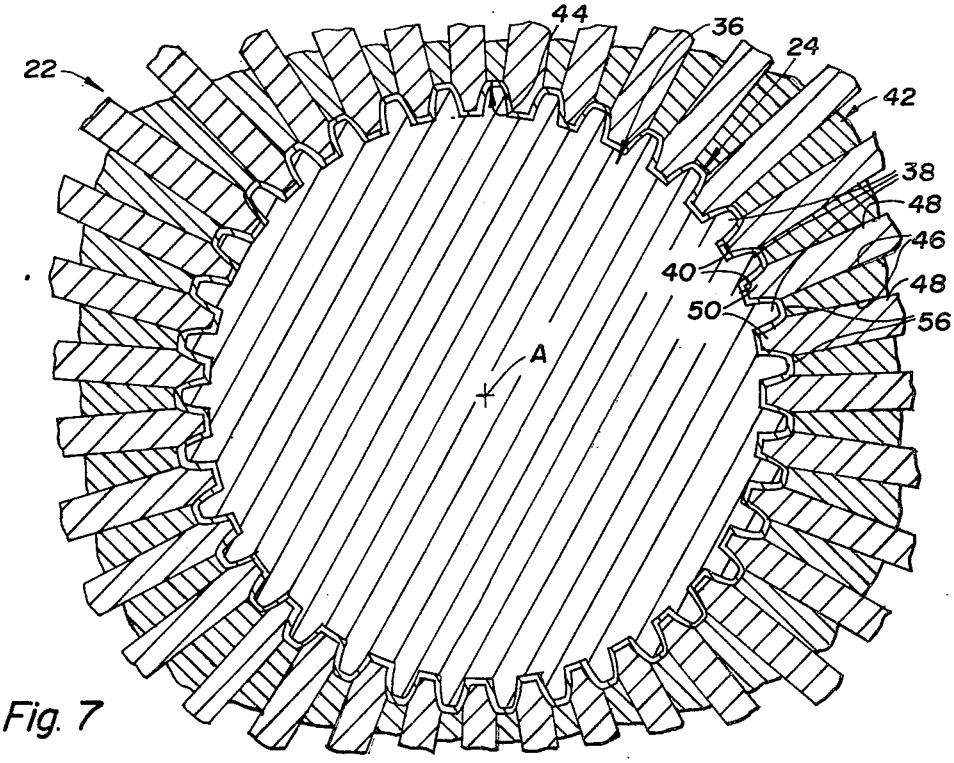
FIG. 7 is a view taken in the same direction as FIG. 6 but after the tools have been moved to perform the forming of the sleeve.

With combined reference to FIGS. 1, 2, and 6, apparatus 22 includes a mandrel 36 for mounting the sleeve 24 during the forming operation. As best seen in FIG. 6, mandrel 36 includes outwardly projecting teeth 38 defining mandrel recesses 40 spaced circumferentially about the central axis A thereof which is concentric with the central axis of the mounted sleeve 24. A tool housing 42 of the apparatus is mounted on the machine housing in a manner which is hereinafter more fully described and, as seen in FIG. 6, includes a central opening 44 in which the sleeve 24 is received upon loading such that the mandrel and the tool housing cooperate to mount the sleeve. Tool housing 42 includes tool slots 46 that are spaced circumferentially about the central axis A of the mounted sleeve 24 extending radially with respect thereto in alignment with the recesses 40 between teeth 38. A plurality of tools 48 of the apparatus are respectively mounted by the tool slots 46 and have forming ends 50 for forming the sleeve 24. Apparatus 22 includes a spring biaser identified by reference numeral 52 in FIGS. 1 through 5 for biasing the tools 48 away from the mounted sleeve in an outward radial direction with respect to axis A. An actuator of the apparatus is identified generally by 54 in FIG. 1 and is operable to move the tools 48 radially against the force of the spring biaser 52 from the position of FIG. 6 to the position of FIG. 7. Upon such movement, the forming ends 50 of the tools 48 form the sleeves 24 into the recesses 40 between the mandrel teeth 38 to form sleeve teeth or splines 56 as shown in FIG. 7. After the forming is completed, the actuator 54 shown in FIG. 1 allows the spring biaser 52 of the tools to move the tools away from the formed sleeve in an outward direction with respect to the axis A of the mandrel in preparation for unloading of the formed sleeve and loading of the next sleeve blank to be formed.

As seen in FIGS. 1 and 2, the machine housing 28 has a front end 58 including a tool housing support 60 with an outer periphery that is secured to the front housing end by spaced bolts 62. A rear surface 64 of the support 60 is engaged by the tool housing 42 as seen in FIG. 1 and is secured thereto by spaced bolts 66. A central opening 68 of the support 60 is aligned with the central opening 44 of the tool housing 42 to permit the loading and unloading operation of the sleeve 24 by loader 30. On the rear side of the tool housing 42, a mandrel support 70 is mounted by spaced bolts 72. Mandrel 36 is secured to the mandrel support 70 by bolts 74 within the tool housing opening 44.

As seen in FIG. 1, the loader 30 includes an unloading cylinder 76 having one end secured by bolts 78 to the support 70 on tool housing 42. A bushing 80 is received within aligned openings in the mandrel 42 and the support 70 and slidably supports the unloading member 34 which constitutes the piston connecting rod of cylinder 76. Conduits 82 and 84 feed and carry hydraulic fluid to and from the cylinder 76 to permit extension and retraction of the unloading member 34 in cooperation with the loading member 32 with the sleeve 24 clamped between the members. Such movement of the loading and unloading members moves the sleeve 24 onto the mandrel 36 to be formed in the manner previously described and thereafter removes the formed sleeve from the mandrel in preparation for the next cycle.

Spring biaser 52 of the apparatus is illustrated in FIGS. 1 through 5 and can be best understood along with a more detailed description of the tool housing 42. As seen in FIG. 1, the tool slots 46 open forwardly toward the rear surface 64 of the support 60 and are closed at their rear extremities by the rear portion 86 of the tool housing. Between each tool slot 46, the tool housing 42 includes pie-shaped segments 88 illustrated in FIGS. 2 and 3 for guiding the tools 48 in a slidable manner. An annular groove 90 formed in the front portion of the tool housing 42 extends across each pie-shaped segment 88 and receives the spring biaser 52 for the tools 48.

Figure 3:
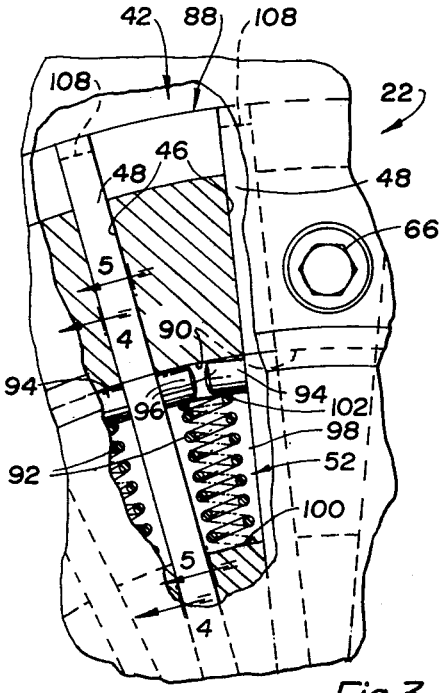
FIG. 3 is an enlarged view of the broken away portion of FIG. 2 and further illustrates the construction of the spring biaser for the tools of the apparatus.

With reference to FIGS. 2 and 3, spring biaser 52 of the forming apparatus is disclosd as including a plurality of springs 92 equal in number to the number of tools 40 and preferably of the helical type. Each of the springs 92 is mounted between a pair of adjacent tools 48 to provide outward biasing thereof away from the mounted sleeve. As illustrated in FIG. 3, each tool 48 includes a pin 94 that extends generally circumferentially with respect to the blade like construction thereof in opposite directions. Each pin 94 includes opposite ends 96 that are engaged by the two springs 92 on each side of the associated tool 48. Annular groove 90 of the tool housing 42 defines spring openings 98 between the tool slots 46 intermediate the inner and outer extremities of the pie-shaped segments 88 of the tool housing as seen in FIG. 3. Each spring 92 is located within an associated opening 98 into which the pin ends 96 from the adjacent tools project. An inner end 100 of each spring 92 is engaged with the tool housing 42 as shown in FIG. 3 at the inner surface of the annular groove 90. An outer end 102 of each spring 92 is engaged with the pin ends 96 projecting into the associated spring opening 98 and biases the tools 48 radially in an outward direction so as to engage the pin ends with the outer surface of the annular groove 90 in the tool housing.

Figure 4:
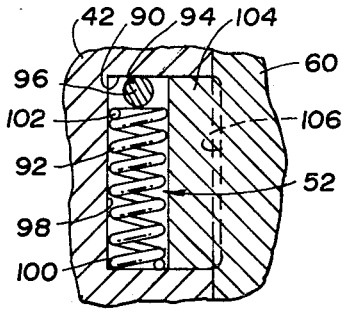
FIGS. 4 and 5 are partial sectional views taken generally along the direction of lines 4—4 and 5—5 in FIG. 3, respectively, and further illustrate the construction of the spring biaser for the tools of the apparatus.

With combined reference to FIGS. 1, 4, and 5, the tool housing 42 and the support 60 cooperate to retain the springs 92 of the spring biaser 52 within the spring openings 98. Support 60 includes rearwardly projecting lugs 104 which have truncated pie shapes complementary to the shapes of the spring openings 98 as viewed in FIG. 3. Each lug 104 thus retains the adjacent spring 92 within the associated opening 98 such that the springs bias the tools 48 in an outward radial direction opposite the inward direction the tools are moved for the forming as previously described. Between each lug 104, the tool housing support 60 is machined to include a slight recess 106 that ensures the slidable support of the adjacent tool 48 for inward and outward movement under the impetus of the spring biaser 52 and the actuator 54 as previously described.

With reference to FIG. 1, each tool 48 includes an outer actuating end 108 that is angled with respect to the axis A a slight extent. Spring biaser 52 is located at intermediate tool portions that extend between the inner forming ends and the outer actuating ends of each tool 48. Tool actuator 54 includes an actuating member 110 having a cone surface 112 that engages the angled actuating ends 108 of all of the tools 48. As illustrated, the cone surface 112 is truncated and faces inwardly toward the central axis A with an angular relationship equal to that of the angled actuating ends 108 of the tools. Spring biaser 52 biases the tools 48 outwardly to engage the ends 108 thereof with the cone surface 112 of actuating member 110. Driven movement of the actuating member 110 toward the right moves the tools 48 inwardly from the position of FIG. 6 to the position of FIG. 7 to provide the sleeve forming as previously described. Thereafter, driven movement of the actuating member 110 back toward the left allows the spring biaser 52 to move the tools 48 outwardly in preparation for unloading of the formed sleeve and commencement of the next cycle.

As seen by continuing reference to FIG. 1, machine housing 28 includes a pair of ribs 114 that mount an annular slide 116 having a front end 118 on which the actuating member 110 is secured by a plurality of bolts 120. A rear end 122 of the slide 116 is secured by bolts 124 to a coupling plate 126 attached to a piston connecting rod 128 of an actuating cylinder 130 of the actuator 54. A support plate 132 is mounted on a rear end 134 of the machine housing 28 and is secured thereto by a plurality of spaced bolts 136. Bolts 138 secure a mounting plate 140 of actuating cylinder 130 to the support plate 132 such that extending and retracting movement of the piston connecting rod 128 of the cylinder provides movement of the slide 116 and actuating member 110 and thereby actuates movement of the tools 48 as previously described. Conduits 82 and 84 of the unloading cylinder 76 respectively extend through openings 142 and 144 in the coupling plate 126 in a manner that permits the movement of actuating member 110 while the unloading cylinder remains stationary.

With continuing reference to FIG. 1, actuating cylinder 130 of the actuator 54 is preferably of the hydraulically driven type and also has a second piston connecting rod 146 projecting from the piston within the cylinder in the opposite direction as the one rod 128. A switch operator 148 is mounted on the rod 146 against a shoulder 150 thereof and carries an annular sleeve seal 152 that cooperates with a stationary sleeve seal 154 on the cylinder 130 in a slidably disposed relationship with respect to each other to seal the left end of the cylinder. A bracket 155 mounted on the left end of the cylinder 130 mounts a pair of limit switches 156 and 158 whose switch arms 160 and 162, respectively, are moved by the operator 148 at the limits of movement of the actuating member 110 of actuator 54. Cylinder driven movement of the actuating member 110 toward the right sufficiently far to move the tools 48 for the sleeve forming previously described trips the switch 156 which then terminates this direction of driving of the cylinder 130 through suitable circuitry and beings to drive the cylinder in the opposite direction in order to permit the spring biaser 52 to move the tools outwardly away from the formed sleeve. The leftward movement of the actuating member 110 results in operation of the switch 158 to terminate the movement of the actuating member 110 toward the left upon completion of the cycle.

During driving movement of actuating member 110 to the left and the right as viewed in FIG. 1, a key 164 on the machine housing 28 and a slot 166 in the actuating member are slidably engaged to prevent rotational movement of the actuating member about the central axis A. Also, upper lubrication passages 167 through the housing 28 and its ribs 114 and connected annular lubrication grooves 168 at the rib surfaces slidably engaged with the slide 116 permit lubrication of the slidable support for the actuating member 110.

Figure 8:
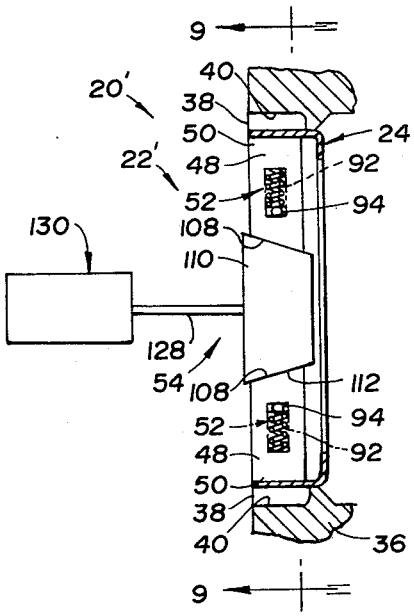
FIG. 8 is a side schematic view of another embodiment of apparatus constructed in accordance with the invention but wherein the forming is performed outwardly rather than inwardly as with the embodiment of FIGS. 1 through 7.

With reference to FIG. 8, another embodiment 20' of the forming machine includes forming apparatus 22' also constructed in accordance with the present invention. Forming apparatus 22' is sufficiently similar to the previously described embodiment such that like reference numerals are applied to like components thereof and much of the prior description is applicable and no repetition thereof is necessary. The basic difference between the forming apparatus 22' and the previously described embodiment of the apparatus is that the forming is performed in an outward direction by outwardly moved tools rather than in an inward direction by inwardly moved tools. Spring biaser 52 of apparatus 22' is the same as the previously described spring biaser except that its biaser springs 92 bias the pins 94 on the tools 48 inwardly rather than outwardly. This bias engages the tool actuating ends 108 with an outwardly facing cone surface 112 on the actuating member 110 connected to the cylinder 130 of the forming apparatus.

Figure 9:
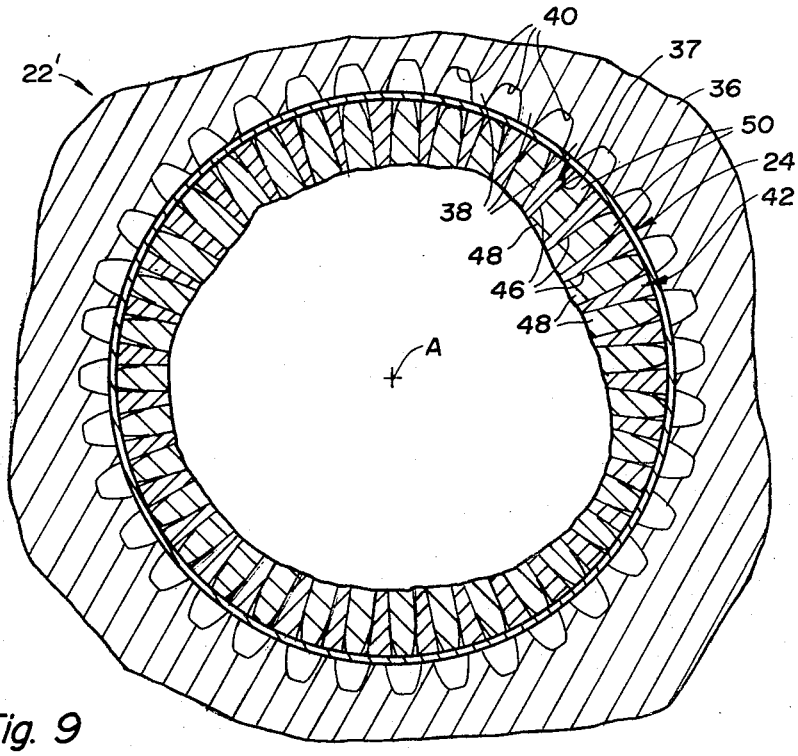
FIG. 9 is a sectional view taken in the direction of line 9—9 through the apparatus of FIG. 8 prior to forming of the thin-wall sleeve.
Figure 10:
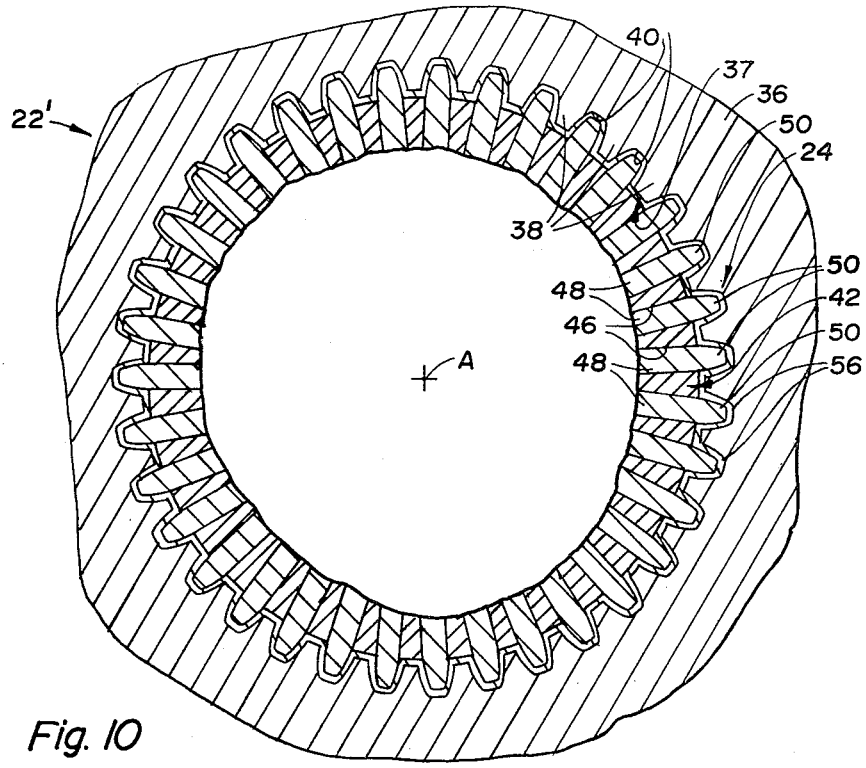
FIG. 10 is a sectional view taken in the same direction as FIG. 9 but illustrating the sleeve after tools have been moved to perform the forming of the sleeve.

With reference to FIG. 9, the mandrel 36 includes a central opening 37 within which the sleeve 24 to be formed is mounted in preparation for the splining. Inward projections 38 of the mandrel define recesses 40 therebetween corresponding to the outer shape of the teeth or splines to be formed. Tool housing 42 of the apparatus 22' is located within the mounted sleeve 24 and cooperates with the mandrel 36 in mounting the sleeve. This housing 42 includes tool slots 46 that are spaced circumferentially about the central axis A of the mounted sleeve 24 extending radially with respect thereto in alignment with the mandrel recesses 40. A plurality of tools 48 are respectively mounted by the tool slots 46 with the outer forming ends 50 thereof having the shape of the interior of the teeth or splines to be formed. Spring biaser 52 shown in FIG. 8 biases the tools 48 radially away from the sleeve 24 in an inward direction. Actuator 54 of the apparatus 22' moves the tools 48 radially against the force of the spring biaser in an outward direction from the position of FIG. 9 to the position of FIG. 10 in order to form the splines or teeth 56. After such forming, the spring biaser 52' moves the tools 48 back inwardly for unloading of the formed sleeve 24 in preparation for the next cycle.

As seen in FIG. 8, the movement of the actuating member 110 toward the right results in its truncated cone surface 112 moving the angled actuating ends 108 of the tools 48 outwardly. Such movement forms the sleeve 24 as previously discussed to form splines or teeth in its annular thin-wall construction. After such forming, movement of the actuating member 110 back toward the left allows the spring biaser 52 to move the tools 48 away from the formed sleeve in an inward direction.

Normally the embodiment of FIGS. 1 through 7 will be utilized to form relatively small diameter thin-wall sleeves which do not have sufficient interior space to permit an internal tool housing to be utilized. Larger diameter sleeves can be formed with the embodiment illustrated in FIGS. 8 through 10 wherein the interior of the sleeve does have sufficient space to receive an internal tool housing. Also, while the term "thin-wall" is defined in standard engineering terminology to mean a round wall having an inner diameter to wall thickness ratio greater than 10, this ratio is much greater for sleeves formed by apparatus constructed in accordance with the present invention. Normally, the ratio for such sleeves is on the order of 50 or more; for example, an internal diameter of 4 and ⅛ inches and a wall thickness of about 1/16 of an inch has a ratio of 66.

Figure 11:
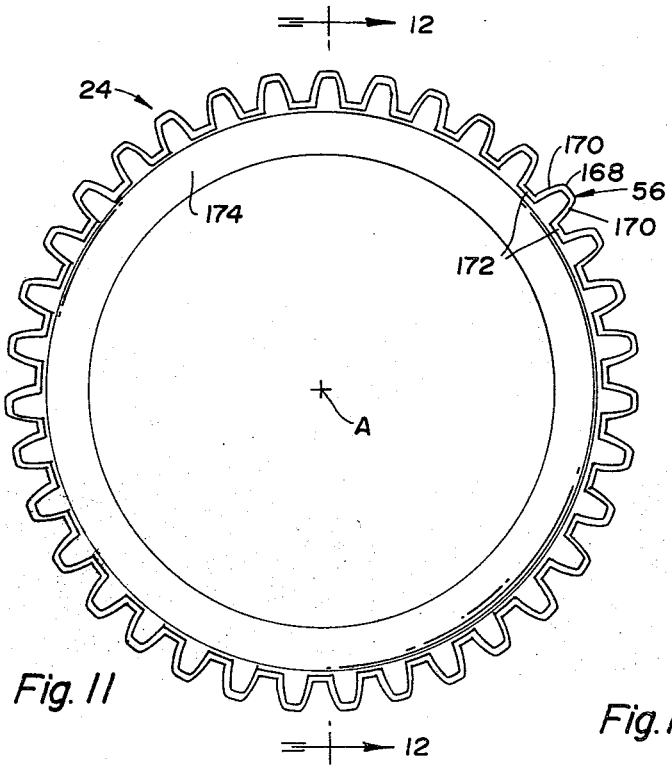
FIG. 11 is a front view illustrating a formed thin-wall sleeve made by either embodiment of apparatus in accordance with the invention.
Figure 12:
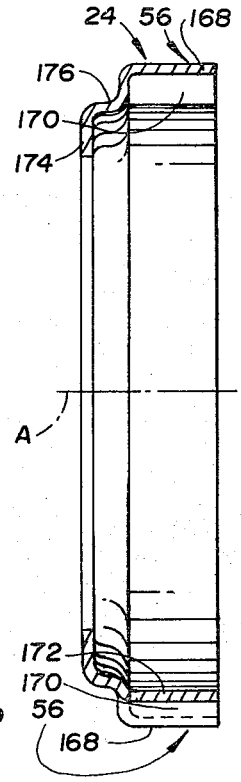
FIG. 12 is a sectional view taken along line 12—12 of FIG. 11 through the formed thin-wall sleeve.

FIGS. 11 and 12 illustrate the formed sleeve 24 including teeth or splines 56 each of which includes a top land wall 168 and a pair of radially extending side walls 170 whose outer extremities are connected to the associated top land wall. Bottom land walls 172 connect the inner extremities of the side walls 170 of the adjacent teeth 56. Of course, the side walls 170 and the bottom land walls 172 will be formed inwardly by the apparatus illustrated in FIGS. 1 through 7, while the top land walls 168 and side walls 170 will be formed outward by the apparatus illustrated in FIGS. 8 through 10. Regardless of which type of forming is utilized, a sleeve end wall 174 is spaced axially by a spacing section 176 from the portion of the sleeve where the splines or teeth 56 are formed such that the end wall is maintained flat to permit mounting of the formed sleeve.

While the best modes for carrying out the invention have been described in detail, those familiar with the art to which this invention relates will recognize various alternative designs and embodiments for practicing the invention as defined by the following claims.

What is claimed is:

1. Apparatus for forming a metallic thin-wall sleeve of a unitary annular construction having a central axis, said apparatus comprising: a mandrel for mounting the sleeve and having recesses spaced circumferentially about the central axis of the mounted sleeve; a tool housing for cooperating with the mandrel in mounting the sleeve and having tool slots that are spaced circumferentially about the central axis of the mounted sleeve extending radially with respect thereto; a plurality of tools respectively mounted by the tool slots and having forming ends for forming the sleeve; a spring biaser including a plurality of springs each of which is mounted between a pair of adjacent tools; each tool including a pin extending circumferentially therefrom in opposite directions; each pin having opposite ends engaged by the springs on each side of the associated tool to bias the tools radially away from the sleeve; and an actuator for moving the tools radially against the force of the spring biaser such that the forming ends of the tools form the sleeve into the recesses of the mandrel whereupon the actuator allows the spring biaser to move the tools radially away from the formed sleeve.

2. Apparatus as in claim 1 wherein the tool housing includes an opening in which the mandrel is located, the spring biaser biasing the tools radially outward, and the actuator moving the tools radially inward to form the sleeve.

3. Apparatus as in claim 1 wherein the mandrel includes an opening in which the tool housing is located, the spring biaser biasing the tools radially inward, and the actuator moving the tools radially outward to form the sleeve.

4. Apparatus as in claim 1 wherein the tool housing includes spring openings respectively located between the tool slots with the springs respectively received therein, and the pin ends projecting into the spring openings to engage the springs in order to bias the tools.

5. Apparatus as in claim 4 wherein the tool housing includes an annular groove that defines the spring openings.

6. Apparatus as in claim 4 or 5 wherein each tool also includes an actuating end, the actuator including an actuating member having a cone surface that engages the actuating ends of the tools, and the actuator also including a cylinder that moves the actuating member axially with respect to the cone surface thereof to move the tools radially.

7. Apparatus for forming a metallic thin-wall sleeve of a unitary annular construction having a central axis, said apparatus comprising: a mandrel for mounting the sleeve and having recesses spaced circumferentially about the central axis of the mounted sleeve; a tool housing for cooperating with the mandrel in mounting the sleeve and having tools slots that are spaced circumferentially about the central axis of the mounted sleeve extending radially with respect thereto; a plurality of tools respectively mounted by the tool slots and having forming ends for forming the sleeve; each tool also including an angled actuating end; each tool further including a pin extending circumferentially therefrom in opposite directions and having opposite ends; a spring biaser including a plurality of springs each of which is located between one adjacent pair of tools; each spring having one end engaged with the tool housing and another end that engages the adjacent pin ends of the tools on each side thereof to bias the tools radially away from the sleeve; and an actuator including an actuating member having a cone surface that engages the angled actuating ends of the tools to move the tools radially against the force of the biaser springs such that the forming ends of the tools form the sleeve into the recesses of the mandrel whereupon the actuator allows the spring biaser to move the tools radially away from the formed sleeve.

8. Apparatus for forming a metallic thin-wall sleeve of a unitary annular construction having a central axis, said apparatus comprising: a mandrel for mounting the sleeve; said mandrel having a central axis and including outwardly extending teeth that engage the mounted sleeve and define recesses between the adjacent pairs of teeth; a tool housing including an opening in which the mandrel is located so as to cooperate with the mandrel in mounting the sleeve; the tool housing having tool slots that are spaced circumferentially about the central axis of the mandrel extending radially with respect thereto; a plurality of tools respectively mounted by the tool slots and having inner forming ends for forming the sleeve; each tool also including an outer actuating end that is angled with respect to the mandrel axis; each tool further including a pin extending circumferentially therefrom in opposite directions and having opposite ends; a spring biaser including a plurality of springs each of which is located between one adjacent pair of tools; each spring having one end engaged with the tool housing and another end that engages the adjacent pin ends of the tools on each side thereof to bias the tools radially outward away from the sleeve; and an actuator including an actuating member having a cone surface that engages the angled actuating ends of the tools to move the tools radially inward against the force of the biaser springs such that the forming ends of the tools form the sleeve into the recesses of the mandrel whereupon the actuator allows the spring biaser to move the tools radially outward away from the formed sleeve.

9. Apparatus for forming a metallic thin-wall sleeve of a unitary annular construction having a central axis, said apparatus comprising: a mandrel for mounting the sleeve; said mandrel having a central axis and including outwardly extending teeth that engage the mounted sleeve and define recesses between the adjacent pairs of teeth; a tool housing including a central opening in which the mandrel is located so as to cooperate with the mandrel in mounting the sleeve; the tool housing have tool slots that are spaced circumferentially about the central axis of the mandrel extending radially with respect thereto; the tool housing also having an annular groove defining a spring opening between each pair of adjacent tool slots; a plurality of tools respectively mounted by the tool slots and having inner forming ends for forming the sleeve; each tool also including an outer actuating end that is angled with respect to the mandrel axis; each tool further including a pin extending circumferentially therefrom in opposite directions and having opposite ends; a spring biaser including a plurality of springs each of which is located between one adjacent pair of tool slots within the spring opening therebetween; each spring having one engaged with the tool housing and another end that engages the adjacent pin ends of the tools on each side thereof to bias the tools radially outward away from the sleeve; an actuator including an actuating member having a cone surface that engages the angled actuating ends of the tools; and the actuator also including a cylinder that moves the actuating member to move the tools radially inward against the force of the biaser springs such that the forming ends of the tools form the sleeve into the recesses of the mandrel whereupon the actuator allows the spring biaser to move the tools radially outward away from the formed sleeve.

10. Apparatus for forming a metallic thin-wall sleeve of a unitary annular construction having a central axis, said apparatus comprising: a mandrel for mounting the sleeve; said mandrel having a central axis and including outwardly extending teeth that engage the mounted sleeve and define recesses between the adjacent pairs of teeth; a tool housing including a central opening in which the mandrel is located so as to cooperate with the mandrel in mounting the sleeve; the tool housing having tool slots that are spaced circumferentially about the central axis of the mandrel extending radially with respect thereto; the tool housing also having an annular groove defining a spring opening between each pair of adjacent tool slots; a plurality of elongated tools respectively mounted by the tool slots; each tool having an inner forming end for forming the sleeve and an outer actuating end that is angled with respect to the mandrel axis; each tool also having an intermediate portion extending between the ends thereof and including a pin that projects in opposite directions therefrom into the spring openings on each side of the associated tool slot; each pin having opposite ends; a spring biaser including a plurality of helical springs each of which is located between one adjacent pair of tool slots within the spring opening therebetween; each helical spring having one end engaged with the tool housing and another end engaged with both pin ends projecting into the associated spring opening such that the springs bias the tools radially outward away from the sleeve; an actuator including an actuating member having a cone surface that engages the angled actuating ends of the tools; and the actuator also including a hydraulic cylinder that moves the actuating member to move the tools radially inward against the force of the biaser springs such that the forming ends of the tools form the sleeve into the recesses of the mandrel whereupon the actuator allows the spring biaser to move the tools radially outward away from the formed sleeve.

* * * * *